US005938065A

United States Patent [19]

De Vivo et al.

[11] Patent Number: 5,938,065

[45] Date of Patent: Aug. 17, 1999

[54] PORTABLE LIQUID STORAGE TANK

[75] Inventors: Mario De Vivo, Newtown; Mariano Tucciarone, Stamford; Tonino Rosati, New Fairfield, all of Conn.

[73] Assignee: Ecological Technologies, Inc., Newtown, Conn.

[21] Appl. No.: 09/070,347

[22] Filed: Apr. 30, 1998

[51] Int. Cl.[6] ..... B65D 90/02

[52] U.S. Cl. ..... 220/562

[58] Field of Search ..... 220/560.03, 1.5, 220/562, 563, 564, 565

[56] References Cited

U.S. PATENT DOCUMENTS

| | | | |
|---|---|---|---|
| 3,339,499 | 9/1967 | Charles et al. | 220/562 |
| 3,460,704 | 8/1969 | Moore et al. | 220/565 |
| 4,018,354 | 4/1977 | Lawler | 220/562 |
| 4,611,724 | 9/1986 | Watkins et al. | 220/562 |
| 4,799,600 | 1/1989 | Gunn et al. | 220/1.5 |
| 5,154,302 | 10/1992 | Alcorn | 220/1.5 |
| 5,353,967 | 10/1994 | Toth et al. | 220/1.5 |
| 5,441,640 | 8/1995 | Baxter | 210/607 |
| 5,553,734 | 9/1996 | Sharp | 220/414 |
| 5,582,311 | 12/1996 | Bartenstein et al. | 220/4.12 |

FOREIGN PATENT DOCUMENTS

| | | | |
|---|---|---|---|
| 259282 | 1/1949 | Switzerland | 220/1.5 |

OTHER PUBLICATIONS

Brochure from Baker Tanks for storage systems, 22 pp.

Brochure from V.E. Enterprises on mobile storage tanks, 9 pp., copyright 1992.

*Primary Examiner*—Stephen Castellano

*Attorney, Agent, or Firm*—David P. Gordon; David S. Jacobson; Thomas A. Gallagher

[57] ABSTRACT

A portable liquid storage tank includes two elongate side walls, two end walls, a floor, and a roof, which are secured together to create a liquid-tight enclosure. The side walls are each preferably formed from a unitary piece of sheet material which is bent into three substantially planar sections which are angled at obtuse angles relative to adjacent sections. The tank thereby has a substantially octagonal shape. The floor is preferably sloped in a shallow V downward away from the side walls to assist drainage toward a drain. Each sidewall preferably includes at least one wedge-shaped brace located along the length of the sidewall and contoured to fit substantially flushly against the three planar sections of the sidewall. A plurality of support beams are secured transversely across the top of the side walls to provide additional structural stability for the roof. Several relatively large entryways are also provided in the tank and doors are provided thereto. The shape of the side walls provides the tank with high strength without the use of complex internal bracing which could hinder the ability of workers to traverse and clean the interior of the tank. The relatively large doorways permits relatively easy passage into and out of the interior of the tank.

23 Claims, 6 Drawing Sheets

PORTABLE LIQUID STORAGE TANK

BACKGROUND OF THE INVENTION

1. Field of the Invention

This invention relates broadly to storage tanks. More particularly, this invention relates to portable storage tanks for temporary liquid storage.

2. State of the Art

Portable liquid storage tanks are used in an array of environmentally sensitive projects requiring temporary liquid storage. Such projects include contaminated ground water treatment, job site clean-up, hazard waste site clean-up, sludge pond clean-up and removal, oil and water separation, tank cleaning and maintenance, underground tank removal, repair and replacement, etc.

Various types of trailer transported or dolly and hitch transported portable storage tanks are utilized in these projects. The tanks are relatively large, capable of containing from 10,000 gallons to over 20,000 gallons of liquid. The liquids may be water, mud, sludge or other liquids with a heavy sediment, corrosive liquids, or other liquids which need to be transported away from or to a site. Due to the amount of liquid held within the tanks, the interior of the tanks will be subject to high pressure. Accordingly, the tanks must be relatively strong and are generally made from a strong rigid steel frame with steel plates affixed thereto to thereby provide a capable storage area.

Referring to prior art FIG. 1, one typical portable tank 10 includes an internal steel frame, generally 12, and a plurality of plates 13 attached to the outside of the frame. The frame 12 is formed by a relatively large number of upright side wall beam members 14 (a reduced number being shown for illustrative convenience), internal braces 16 which reinforce the side wall beam members 14, top braces 18 to support a roof portion 20, and lower bracing 24 across the lower portion of the tank which is provided with a floor 22 attached to the underside thereof. A conventional manway 26, typically approximately twenty-two inches in diameter, permits access into the interior of the tank.

The tank of prior art FIG. 1 has several disadvantages. First, the internal frame, particularly the internal braces, creates a dangerous barrier for workers who must physically enter the tank to clean the tank with water jets from high powered water hoses. Second, the junctions of the beam members, braces, and plates create interstitial spaces, which when the tank is filled with corrosive liquids, subject the surrounding locations of the tank to corrosion and may eventually breach the structural integrity of the tank. Third, upon removing a liquid from the tank, the interstitial locations and floor bracing make the tank particularly difficult to clean prior to receiving subsequent liquid contents. As a result, subsequent liquid contents of the storage tank can be contaminated by remnant liquids. In addition, the relatively small size of the manway creates difficulty for workers to enter and exit the tank. Moreover, sediment remaining in the tank after the liquid has been drained, e.g., remaining sludge, needs to be removed from the tank. However, the small size of the manways are inefficient for this sediment removal. Nevertheless, the small size of the conventional manway is dictated by the need to maintain structural stability of the plate through which the manway is provided when the tank is filled with liquid.

Other prior art tanks (not shown), such as the 10K Mobile Liquid Storage System available from Baker Tanks of Rancho Dominguez, Calif., or the FLUID BIN™ Roll-Off Box from V. E. Enterprises, Inc. of Springer, Okla., are similarly designed but utilize corrugated steel side walls to provide high strength to the side walls without necessitating internal bracing. This type of tank has severe drawbacks. First, such tanks are much more difficult to clean than tanks having flat wall sections. Water jets from high powered hoses do not satisfactorily clean the depths of the corrugations and the extra labor required for physical cleaning is extremely costly and time consuming. Second, the corrugated walls are susceptible to attack from corrosive liquids.

U.S. Pat. No. 5,582,311 to Bartenstein et al. discloses another tank design which attempts to eliminate several disadvantages found in prior tanks. Referring to prior art FIG. 2, the Bartenstein et al. tank 50 includes walls 52 and a frame 54 located outside the walls. The frame 54 includes beam members 56 connected by moment resisting joints 58. The floor 60 of the tank 50, free from internal bracing, is also sloped in a shallow V to encourage the flow of liquid toward a drain (not shown). The interior of the tank 50, free of structure (no bracing beams) and having a sloped floor, permits workers to freely move about the tank and makes it relatively easier to clean with jets of water than other storage tanks. However, the corners of the tank are still formed at approximately ninety degree angles and have a tendency to retain fluid and particularly sediment settling from the fluids even after cleaning. In addition, the tank is labor intensive and costly to construct, requiring a complex assemblage of beams and steel plate side walls. Moreover, the Bartenstein et al. patent does not address the difficulty workers have entering into and exiting from tanks through manways.

SUMMARY OF THE INVENTION

It is therefore an object of the invention to provide a portable liquid storage tank which is relatively easy to clean.

It is also an object of the invention to provide a portable liquid storage tank which is not particularly susceptible to corrosion.

It is another object of the invention to provide a portable liquid storage tank which has minimal internal structure.

It is a further object of the invention to provide a portable liquid storage tank which accommodates workers inside the tank.

It is an additional object of the invention to provide a portable liquid storage tank which permits easy access into and out of the tank.

In accord with these objects, which will be discussed in detail below, a portable liquid storage tank is provided which includes two elongate side walls, two end walls, a floor, and a roof, which are secured together to create a liquid-tight enclosure. The side walls are each preferably formed from a unitary piece of sheet material which is bent (or otherwise formed) into three substantially planar sections, each section being angled at an obtuse angle relative to an adjacent section. The tank thereby assumes a substantially octagonal shape. In addition, the floor is preferably sloped in a shallow V downward away from the side walls to assist drainage toward a drain. Each sidewall preferably includes a wedge-shaped brace, preferably centrally located along the length of the sidewall and contoured to fit substantially flushly against the three planar sections of the sidewall. A plurality of support beams are secured transversely across the top of the side walls to provide additional structural stability for the roof. Several relatively large entryways are also provided into the tank and doors are provided for that purpose.

It will be appreciated that the shape of the side walls which incorporates the obtuse angles provides the tank with high strength without the use of complex internal bracing which could hinder the ability of workers to traverse the interior of the tank. Moreover, the obtuse angles bent into the side walls and the wedge-shaped brace create a storage location which includes no ninety degree or acute angles between the end walls. Therefore, it is relatively easy to clean the contents from the tank, and the tank has reduced susceptibility to corrosion. Furthermore, the relatively large doorways permits relatively easy passage into and out of the interior of the tank.

Additional objects and advantages of the invention will become apparent to those skilled in the art upon reference to the detailed description taken in conjunction with the provided figures.

BRIEF DESCRIPTION OF THE DRAWINGS

Prior art

Prior art

DETAILED DESCRIPTION OF THE PREFERRED EMBODIMENTS

Figure 1:
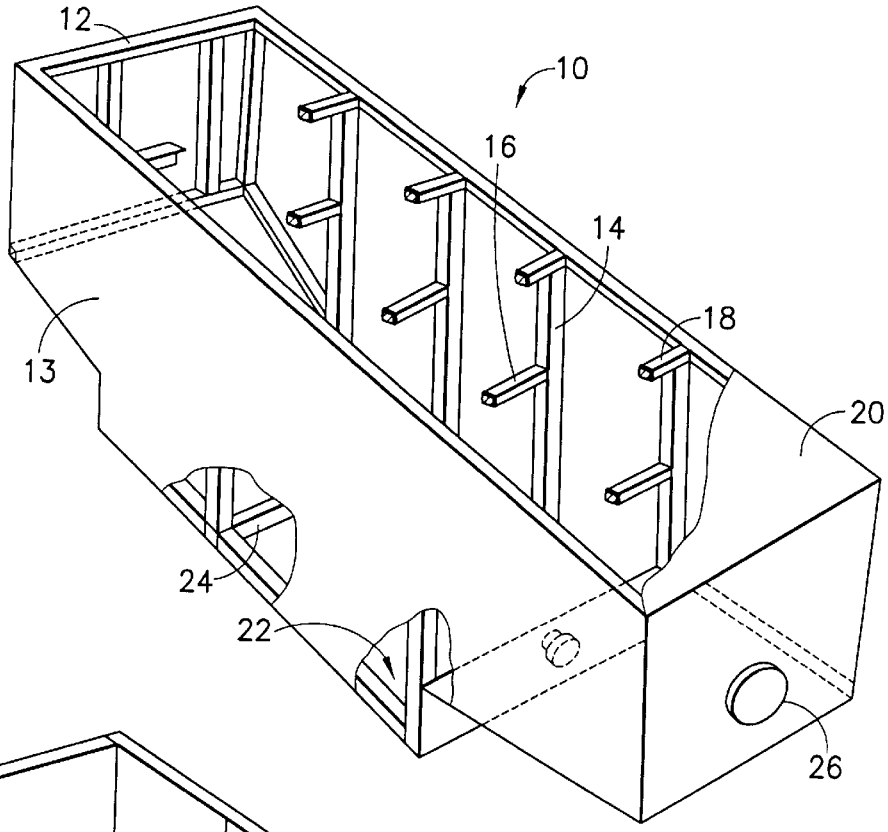
FIG. 1 PRIOR ART
FIG. 1 is a perspective sectional view of a first prior art liquid storage tank.
Figure 2:
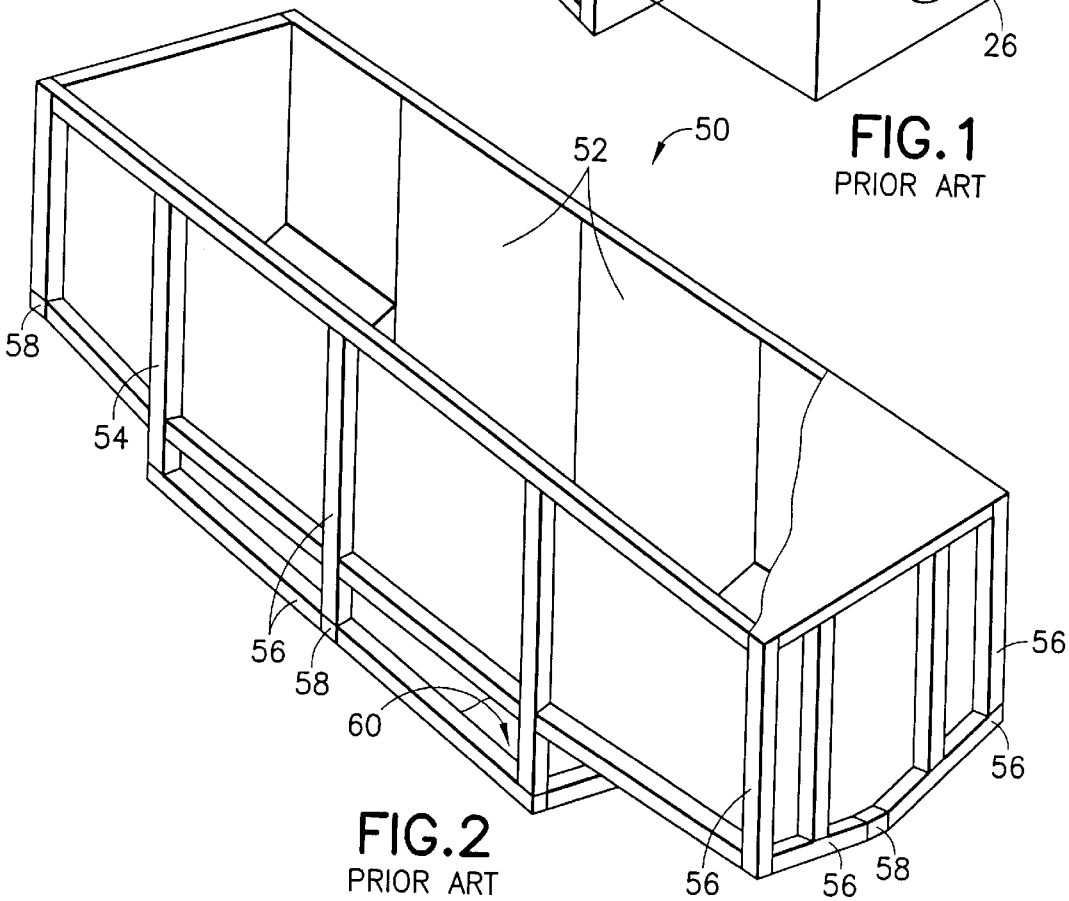
FIG. 2 PRIOR ART
FIG. 2 is a perspective sectional view of a second prior art liquid storage tank.
Figure 3:
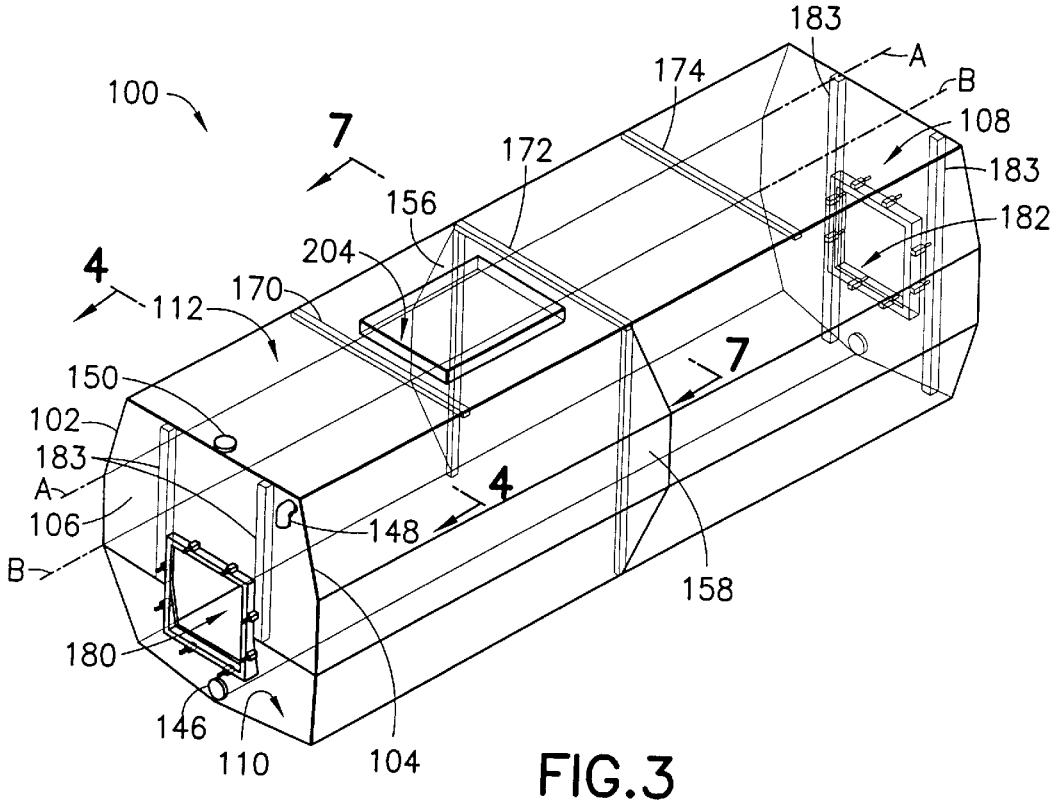
FIG. 3 is a transparent perspective view of a first embodiment of a portable liquid storage tank according to the invention.

Turning now to FIG. 3, a portable liquid storage tank 100 according to the invention is shown. The portable liquid storage tank 100 includes two elongate side walls 102, 104, two end walls 106, 108, a floor 110, and a roof 112. The side walls 102, 104, end walls 106, 108, floor 110, and roof 112 are secured together, preferably by welding, to create a liquid-tight enclosure.

Figure 4:
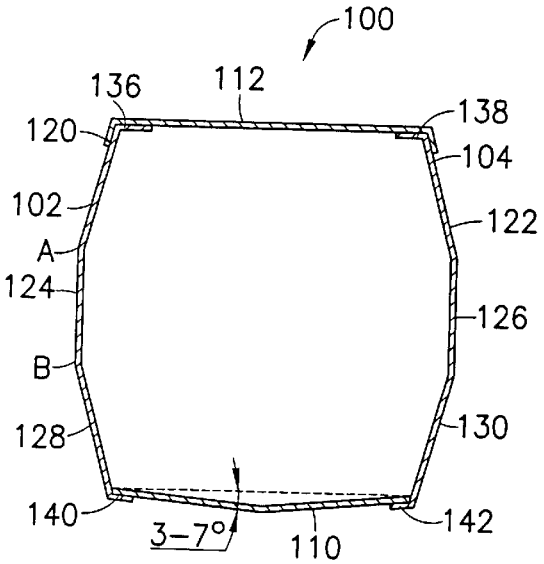
FIG. 4 is a section view across line 4—4 in FIG. 3.
Figure 7:
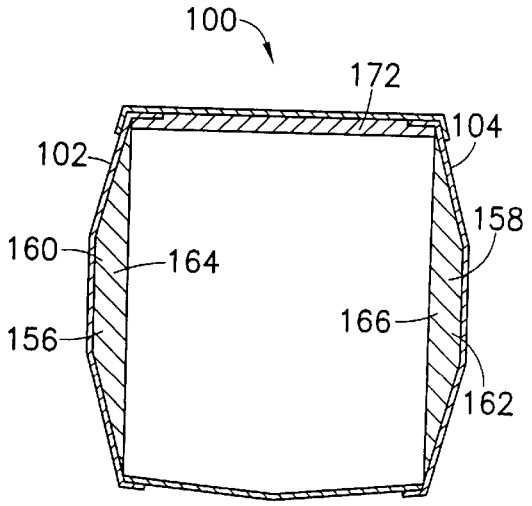
FIG. 7 is a section view across line 7—7 in FIG. 3.

Referring to FIGS. 3 and 4, the side walls 102, 104 are each preferably formed from a unitary piece of sheet material, such as steel, which is bent (or otherwise formed) into preferably three substantially planar sections: an upper section 120, 122, a central section 124, 126, and a lower section 128, 130. Each side wall is bent along two lines, e.g., lines A and B with respect to side wall 102, to create the three planar sections, each planar section being angled preferably at between approximately 135° and approximately 175°, and more preferably between 155° and 170°, relative to adjoining planar sections. Lines A and B are preferably parallel and together define a vertical plane. When viewing a cross section of the tank (FIG. 4), the tank 110 preferably has a substantially octagonal shape (the two side walls 102, 104 forming three sides each, the floor 110, and the roof 112). In addition, each side wall 102, 104 preferably includes an upper flange 136, 138 and a lower flange 140, 142. Upper flanges 136, 138 and lower flanges 140, 142 provide planar surfaces to which the floor 110 and roof 112, respectively, may be welded or otherwise secured.

Turning now to FIGS. 3 and 5–7, according to a preferred embodiment of the invention, each sidewall 102, 104 includes a single brace 156, 158, preferably centrally located along the length of the sidewall. The brace is coupled to the sidewall and preferably extends from the roof 110 to the floor 112. Each brace 156, 158 is wedge-shaped (shown best in FIG. 5) and has a back portion 160, 162 contoured to fit substantially flushly against the three planar sections of the sidewall, and a front tapered portion 164, 166; i.e., that portion laterally entering into the storage area of the tank and extending vertically from the roof 112 to the floor 110. It will be appreciated that the wedge shape of the braces 156, 158 causes the junction of each brace and its sidewall 102, 104 occurs at an obtuse angle. Each brace is preferably welded to its respective side wall.

It will be appreciated that the shape of the side walls provides the tank with high strength without the use of complex internal bracing which could hinder the ability of workers to traverse the interior of the tank. Only a single unobtrusive brace is preferred. Moreover, the obtuse angles bent into the side walls and the angles at the junction of the wedge-shaped brace and sidewall create a storage location which includes no ninety degree or acute angles between the end walls. Therefore, it is relatively easy to clean the contents from the tank with jets of water, and the tank has reduced susceptibility to corrosion.

Figure 5:
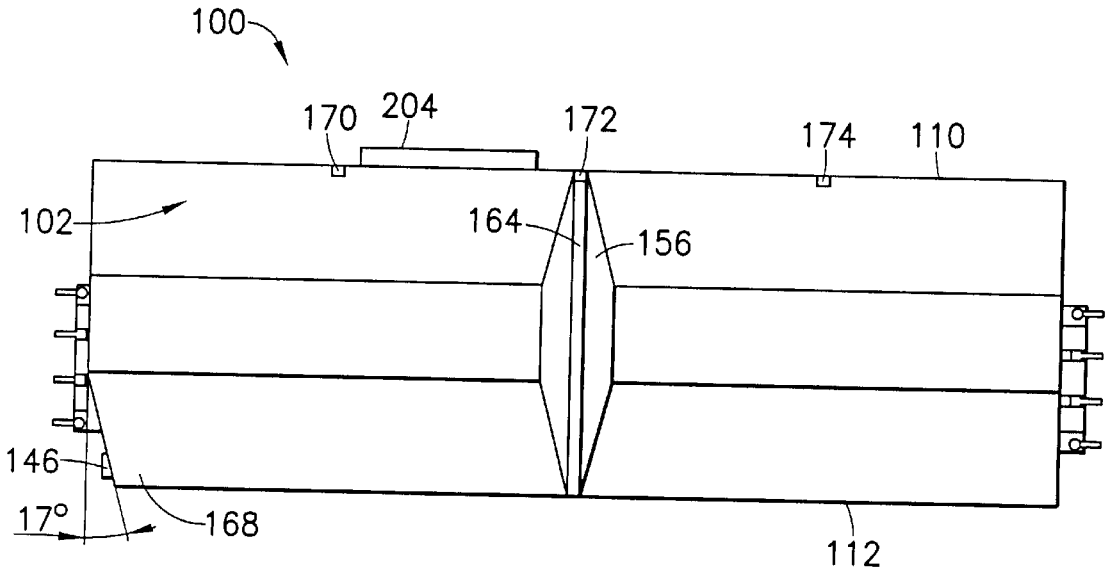
FIG. 5 is a longitudinal section view of the first embodiment of the portable liquid storage tank of the invention.
Figure 6:
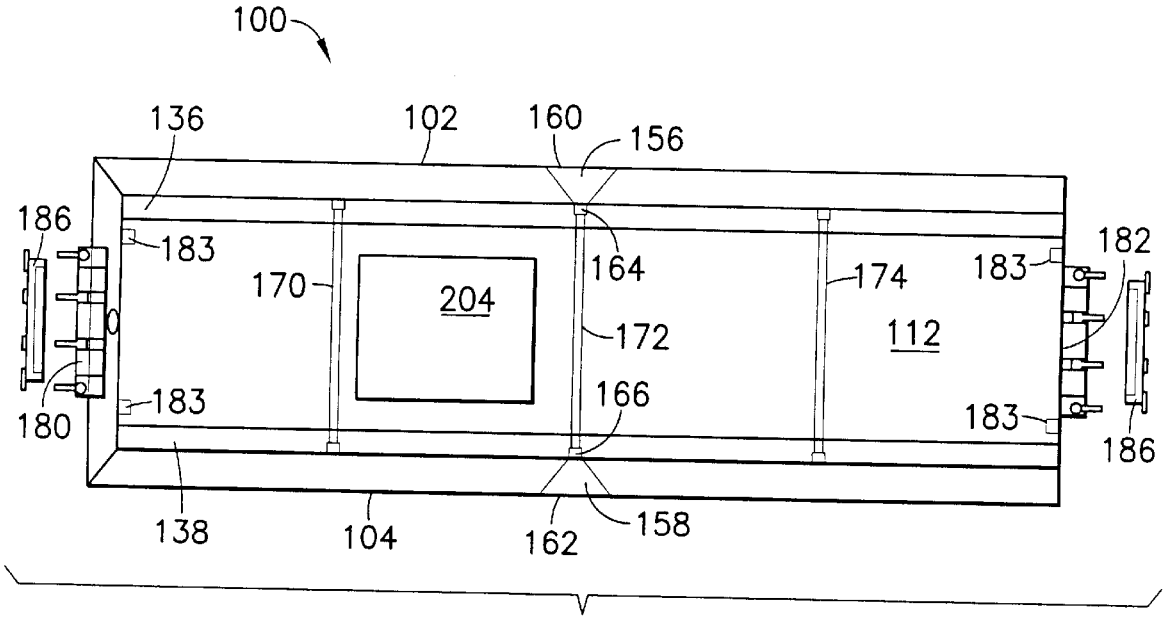
FIG. 6 is a transparent top view of the portable liquid storage tank of the first embodiment of the invention.

Still referring to FIGS. 3 and 4, the floor 110 is preferably sloped in a shallow V downward away from the side walls 102, 104. The slope is preferably 3° to 7° from horizontal. At least one end wall 106 (and preferably both end walls 106, 108) include a drainage port 146 adjacent the floor 110. In addition, at least one exhaust 148 is provided in the tank, preferably in end wall 106. An input port 150 is provided in the roof 112 for receiving liquid into the tank 100. Moreover, a lower portion of the end wall 106 (that portion coextensive with the lower sections 128, 130 of the side walls 102, 104) is preferably angled 17° relative to the rest of the end wall toward the interior of the tank 100, such that the end wall 106 and floor join in an obtuse angle. The angled lower portion of the end wall operates to eliminate a hard-to-clean 90° angle at the intersection of end wall 106 and the floor 112 in the area 168 adjacent the drainage port 146 (FIG. 5).

In the preferred embodiment, three roof reinforcement beams 170, 172, 174 are secured transversely across the top of the side walls 102, 104, preferably by bolting into the sidewalls (e.g., at the upper flanges). The support beams provide additional structural stability for the roof 112 and permit the roof to bear the weight of workers thereon without substantial buckling.

Figure 8:
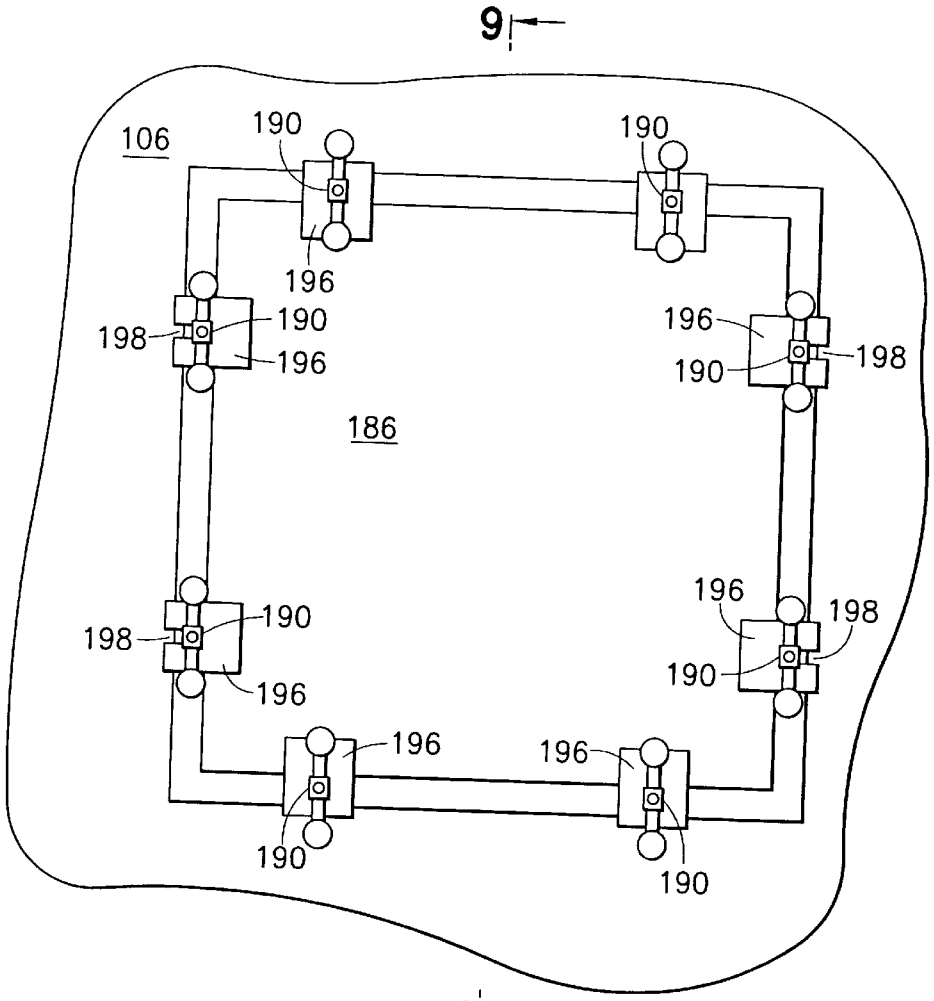
FIG. 8 is a front section view of a doored entryway into the portable liquid storage tank of the first embodiment of the invention.
Figure 9:
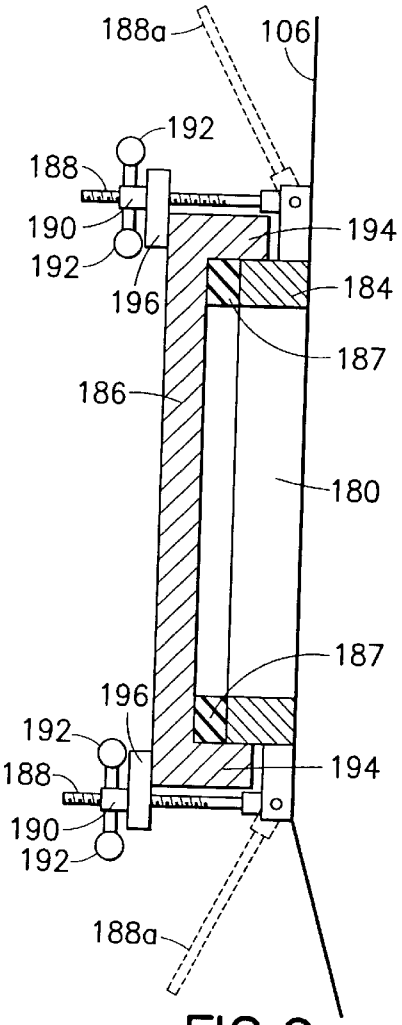
FIG. 9 is a partial section view across line 9—9 in FIG. 8.

Referring back to FIG. 3, several relatively large, reinforced entryways 180, 182 are provided in the end walls 106, 108 of the tank 100. The entryways 180, 182 include an opening which is preferably approximately thirty-six inches in each of width and height; i.e., sized to easily permit a worker to enter and exit the tank. In addition, the large size of the entryways 180, 182 enables sediment and sludge-like material to be removed from the tank via shoveling out of the entryways, which is very difficult with the small prior art manways. Vertical reinforcing beams 183 are provided to the interior side of the end wall on either side of the entryways 180, 182. Referring to FIGS. 8 and 9 and with respect to entryway 180 (entryway 182 is preferably of the same design as entryway 180), the entryway 180 is provided with a tubular frame 184, preferably comprised of two inch by six inch tubular steel, which is provided to the outside of the end wall 106 and serves to locate a fully removable door 186 thereabout. A gasket 187 is interposed between the frame 184 and the door 186, and is coupled to the frame 184. The gasket 187 is preferably a one piece laser-cut two inch by one inch piece of rubber or another resilient material. Coupled about the periphery of the frame 184 are a plurality of pivotable threaded bolts 188, e.g., two around each of the four sides of the entryway 180. Each bolt 188 is provided with a nut 190 having handles 192 for rapidly tightening and loosening the nut over the bolt, and attaching the door 186 over the entryway 180. The door 186 includes bent edges 194 sized to fit about the frame 184, and a plurality of brackets 196 welded (or otherwise securely attached) to the back of the door 186. The brackets 196 each have a slot 198 sized to permit a bolt 188 to extend therethrough. The slots 198 of the brackets 196 are respectively positioned for receiving one of the bolts 188 into each slot.

In practice, to attach a door 186 over an entryway 180, the bolts are pivoted to the location shown as 188*a*, the bent edges 194 of the door are positioned over the frame 184, and the bolts are pivoted to enter into the slots 198 of the brackets 196 of the door. The nuts 190 are then thread over the bolts 188, using handles 192 to quickly rotate the nuts to seat the nuts against the brackets 196 and tighten the door 186 over the entryway 180. Detaching the door 186 requires a substantially opposite operation.

Referring back to FIG. 3, a roof-top entry 204 is also preferably provided in the roof 112. A hinged door 206 (FIG. 10) is coupled to the roof to provide (and block) entry into the tank from the roof.

Figure 10:
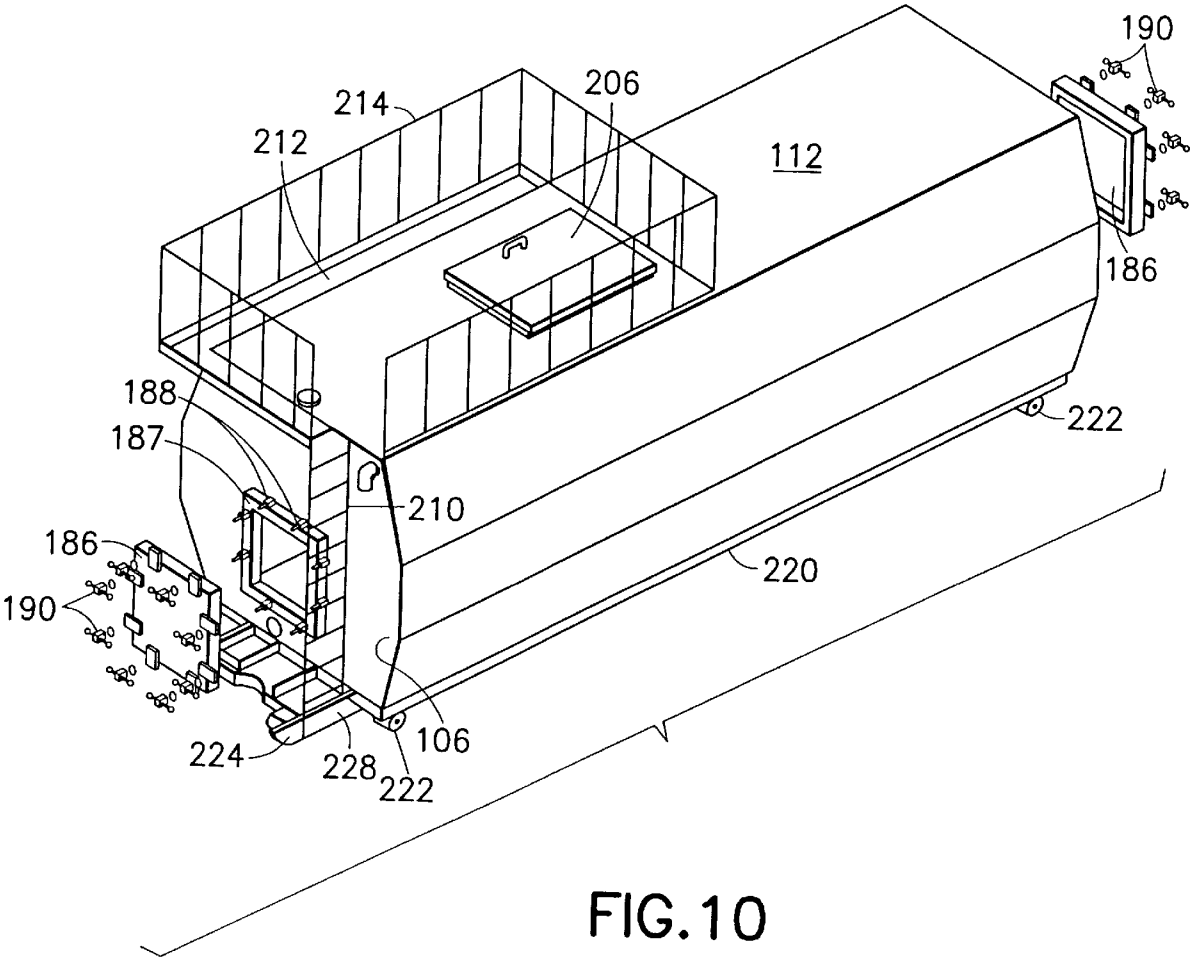
FIG. 10 is an exploded perspective view of the portable liquid storage tank according to the first embodiment of the invention mounted on a dolly and provided with a rooftop gate.
Figure 11:
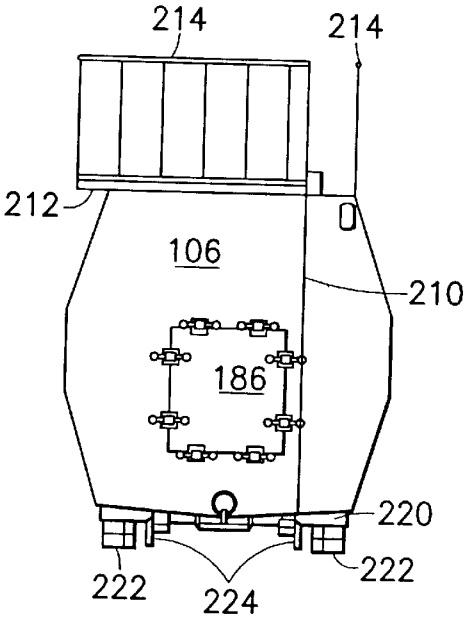
FIG. 11 is an end view of the portable liquid storage tank as shown in FIG. 10.

Turning now to FIGS. 10 and 11, a ladder 210 preferably extends along the height of at least one of the end walls 106 and provides worker access to the roof 112. A roof-top extension 212 is optionally provided along a portion of the perimeter of the roof 112 to provide easier access to the roof from the ladder 210 and to provide greater roof top surface area for workers to stand on, especially when opening the door 206. A fence 214 is also preferably provided on the roof 112 to enclose the area of the roof including the door 206 and the roof-top extension 212, yet open to provide access to roof from the ladder 210.

The tank 100 may be provided on a dolly 228 to facilitate transportation of the tank to and from work sites. The dolly 228 preferably includes a bed 220 designed to hold the tank 100, wheels 222, and a towing hitch 224 for coupling the dolly 228 to a truck cab.

Figure 12:
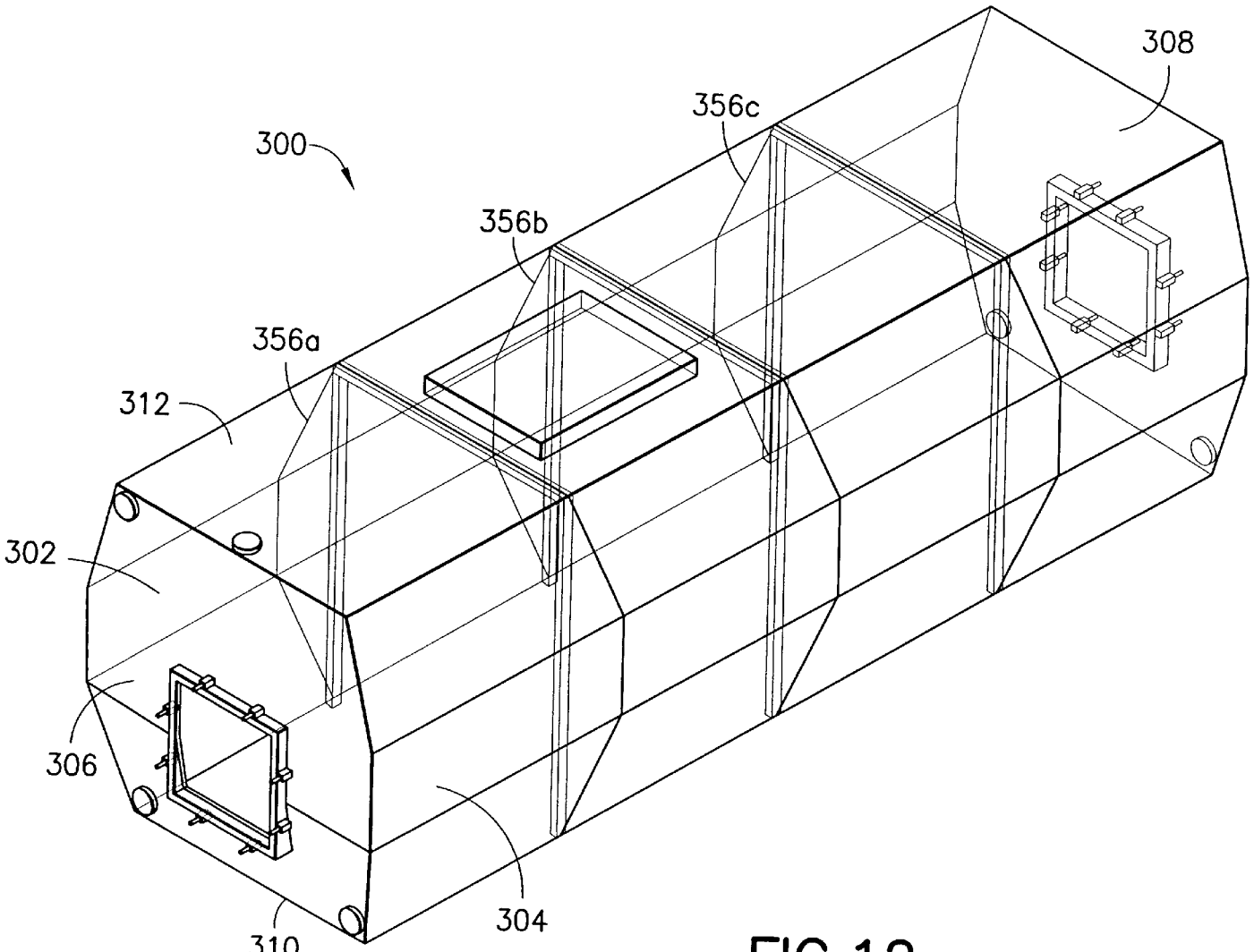
FIG. 12 is a transparent perspective view of a second embodiment of a portable liquid storage tank according to the invention.

Referring now to FIG. 12, a second embodiment of a portable liquid storage tank 300 according to the invention, substantially similar to the first embodiment (with like parts having numbers incremented by 200) is shown. The tank 300 includes two elongate side walls 302, 304, two end walls 306, 308, a floor 310, and a roof 312. The side walls 302, 304 are bent into three section as previously described. With respect to each side wall, e.g., side wall 302, three wedge-shaped braces 356*a*, 356*b*, 356*c* are provided along the side wall. Preferably the braces 356*a*, 356*b*, 356*c* are equally spaced along the side wall 302 between the end walls 306, 308. The floor 210 is substantially planar. Other aspects of the second embodiment of the tank are preferably as described with respect to the first embodiment of the portable liquid storage tank.

By way of example only, and not by way of limitation, the following dimensions are provided for a portable liquid storage tank according to the invention. The roof and floor are each preferably approximately 83 inches wide, preferably approximately 290 inches long, and preferably approximately 3/16 inches thick. The side walls are preferably approximately 3/16 inches thick, preferably approximately 290 inches in length and, as described above, are bent to define three sections, each preferably approximately 30 inches in height, and include upper and lower flanges each preferably approximately 6 inches in width and preferably running the length of the side wall. The width of the tank at its widest is approximately 101 inches, and the height of the tank from floor to roof is approximately 90 inches. The end walls are preferably approximately 3/16 inches thick and are dimensioned in width and height to fit with the side walls, the roof, and the floor. The length of the tank from end wall door to end wall door is approximately 318 inches. The capacity of the tank is approximately 10,000 gallons.

There have been described and illustrated herein embodiments of a portable liquid storage tank. While particular embodiments of the invention have been described, it is not intended that the invention be limited thereto, as it is intended that the invention be as broad in scope as the art will allow and that the specification be read likewise. Thus, while particular dimensions of the tank have been disclosed, it will be appreciated that other sizes of the tank may be constructed as well. Furthermore while particular types of entryways, doors, and closures therefor have been disclosed, it will be understood that other entryways, door, and closures therefor can be used. For example, and not by way of limitation, the closures may include angled brackets which are extendable from adjacent the frame to around the back of the door and which can be removably secured thereabout. Also, while three roof beams are preferred, it will be recognized that a fewer or greater number of beams can be used. Moreover, while one brace is preferred, and three braces are shown in a second non-preferred embodiment, it will be appreciated that no braces or two or more than three braces may be used. In addition, while the braces are preferably wedge-shaped (to aid tank cleaning), the braces can be provided with another shape. Also, while reinforcing members are provided to the end walls about the entryways in a vertical orientation, it will be appreciated that the reinforcing members may be oriented horizontally or diagonally. Moreover, while the side walls have preferably been bent into three sections, the side wall may alternatively be bent into more than three sections, provided that sufficient structural integrity is thereby provided to the tank. Also, while a roof has been shown in the embodiments described, it will be appreciated that the tank need not be provided with a roof. Furthermore, while a drain has been shown located in a lower central portion of an end wall, it will be appreciated, especially with respect to the second embodiment, that the drain can be elsewhere located, e.g., the drain may be located in a side wall, the floor, or in a corner of the end wall. Likewise the exhaust can also be elsewhere located, e.g., in an upper portion of a side wall or the roof. It will therefore be appreciated by those skilled in the art that yet other modifications could be made to the provided invention without deviating from its spirit and scope as so claimed.

What is claimed is:

1. A portable liquid storage tank, comprising:

a) first and second elongate side walls, each being bent at an obtuse angle along each of respective two parallel substantially horizontal lines such that each said side wall defines top, central, and bottom non-horizontal portions such that said side walls are bent outward relative to the other, said central portions being substantially vertically oriented said top and bottom portions not being substatially vertically oriented;

b) first and second end walls substantially perpendicularly secured to said first and second side walls; and c) a floor securely coupled to said first and second side walls and said first and second end walls, said first and second side walls, said first and second end walls, and said floor together defining a liquid-tight interior storage location.

2. A portable liquid storage tank according to claim 1, wherein:

said top and central portions of each of said first and second side walls are angled 135°–175° relative to each other, and said bottom and central portions of each of said first and second side walls are angled 135°–175° relative to each other.

3. A portable liquid storage tank according to claim 1, further comprising:

d) a roof coupled to said first and second side walls and said first and second end walls to enclose said interior storage location.

4. A portable liquid storage tank according to claim 3, wherein:

a cross-section taken parallel to said first end wall is substantially octagonally shaped.

5. A portable liquid storage tank according to claim 3, wherein:

said first and second side walls include respective upper flanges, and said roof is welded to said first and second side walls at said respective upper flanges.

6. A portable liquid storage tank according to claim 3, further comprising:

e) roof reinforcing means for reinforcing said roof.

7. A portable liquid storage tank according to claim 1, wherein:

each of said side walls is comprised of a unitary piece of material.

8. A portable liquid storage tank according to claim 1, further comprising:

d) at least one brace coupled to each of said first and second side walls, each brace being substantially vertically oriented and having a shape contoured to fit against its respective side wall.

9. A portable liquid storage tank according to claim 8, wherein:

each said at least one brace is wedge-shaped.

10. A portable liquid storage tank according to claim 1, wherein:

said floor is provided with a shallow V shape.

11. A portable liquid storage tank according to claim 1, wherein:

said first and second side walls include respective lower flanges, and said floor is welded to said first and second side walls at said respective lower flanges.

12. A portable liquid storage tank according to claim 1, wherein:

at least one of said first and second end walls is provided with a rectangularly-shaped entryway.

13. A portable liquid storage tank according to claim 12, further comprising:

d) wall reinforcing means coupled to said at least one of said first and second end walls being provided with said entryway.

14. A portable liquid storage tank according to claim 12, wherein:

each said entryway is provided with a fully removable door.

15. A portable liquid storage tank according to claim 12, wherein:

each said entryway is at least approximately thirty inches in width and at least approximately thirty inches in height.

16. A portable liquid storage tank according to claim 1, wherein:

at least one of said first and second side walls, said first and second end walls, and said floor is provided with a sealed drain.

17. A portable liquid storage tank according to claim 1, wherein:

at least one of said first and second side walls, said first and second end walls, and said roof is provided with an exhaust vent.

18. A portable liquid storage tank according to claim 3, wherein:

a distance from a central portion of said first side wall to a central portion of said second side wall is approximately 101 inches, and a distance from said floor to said roof is approximately 90 inches, and a length of said tank is approximately 318 inches.

19. A portable liquid storage tank according to claim 1, wherein:

at least one said first and second end walls is coupled to said floor at an obtuse angle.

20. A portable liquid storage tank, comprising:

a) first and second elongate side walls, each being bent at an obtuse angle along each of respective two parallel substantially horizontal lines such that each said side wall defines top, central, and bottom non-horizontal portions and such that said side walls are bent outward relative to the other, said top and central portions of each of said first and second side walls being angled 135°–175° relative to each other, and said bottom and central portions of each of said first and second side walls being angled 135°–175° relative to each other;

b) first and second end walls substantially perpendicularly secured to said first and second side walls; and c) a floor securely coupled to said first and second side walls and said first and second end walls, said first and second side walls, said first and second end walls, and said floor together defining a liquid-tight interior storage location.

21. A portable liquid storage tank, comprising:

a) first and second elongate side walls, each being bent at an obtuse angle along each of respective two parallel substantially horizontal lines such that each said side wall defines top, central, and bottom non-horizontal portions and such that said side walls are bent outward relative to the other, said first and second side walls additionally including respective upper flanges;

b) first and second end walls substantially perpendicularly secured to said first and second side walls;

c) a floor securely coupled to said first and second side walls and said first and second end walls; and d) a roof welded to said first and second side walls at said respective upper flanges and said first and second end walls, said first and second side walls, said first and second end walls, and said floor and said roof together defining a liquid-tight interior storage location.

22. A portable liquid storage tank, comprising:

a) first and second elongate side walls, each being bent at an obtuse angle along each of respective two parallel substantially horizontal lines such that each said side wall defines top, central, and bottom non-horizontal portions and such that said side walls are bent outward relative to the other;

b) at least one brace coupled to each of said first and second side walls, each brace being substantially vertically oriented and having a shape contoured to fit against its respective side wall;

c) first and second end walls substantially perpendicularly secured to said first and second side walls; and d) a floor securely coupled to said first and second side walls and said first and second end walls, said first and second side walls, said first and second end walls, and said floor together defining a liquid-tight interior storage location.

23. A portable liquid storage tank according to claim 22, wherein:

each said at least one brace is wedge-shaped.

* * * * *